United States Patent [19]

Yamada

[11] Patent Number: 4,658,205

[45] Date of Patent: Apr. 14, 1987

[54] REFERENCE VOLTAGE GENERATING CIRCUIT

[75] Inventor: Kazuyoshi Yamada, Tokyo, Japan

[73] Assignee: NEC Corporation, Japan

[21] Appl. No.: 763,462

[22] Filed: Aug. 7, 1985

[30] Foreign Application Priority Data

Aug. 10, 1984 [JP] Japan ..... 59-167466

[51] Int. Cl.[4] ..... G05F 3/16

[52] U.S. Cl. ..... 323/313; 323/907; 307/310

[58] Field of Search ..... 323/312, 313, 314, 907; 307/310

[56] References Cited

U.S. PATENT DOCUMENTS

| | | | |
|---|---|---|---|
| 4,091,321 | 5/1978 | Hanna | 323/907 X |
| 4,282,477 | 8/1981 | Ahmed | 323/312 |
| 4,390,799 | 6/1983 | Schmoock | 307/310 |
| 4,460,865 | 7/1984 | Bynum et al. | 323/313 |
| 4,533,842 | 8/1985 | Yang et al. | 323/313 X |
| 4,570,115 | 2/1986 | Misawa et al. | 323/313 |

*Primary Examiner*—Patrick R. Salce
*Assistant Examiner*—Marc S. Hoff
*Attorney, Agent, or Firm*—Laff, Whitesel, Conte & Saret

[57] ABSTRACT

A reference voltage generating circuit is constituted by a source of constant current, a power supply having high and low voltage terminals, an emitter follower circuit connected across the high and low voltage terminals, first and second resistors with their one ends respectively connected to the high voltage terminal and the output terminal of the source of constant current and the other ends connected to the input terminal of the emitter follower circuit, a third resistor with one end connected to the high voltage terminal, and a diode with its anode electrode connected to the other side of the third resistor and its cathode electrode connected to the output terminal of the source of constant current.

4 Claims, 5 Drawing Figures

REFERENCE VOLTAGE GENERATING CIRCUIT

BACKGROUND OF THE INVENTION

This invention relates to a reference voltage generating circuit, particularly to the reference voltage generating circuit wherein a temperature characteristic of an output voltage is set as desired.

In the past, as a reference voltage generating circuit has been used a circuit shown in FIG. 1 comprising a resistor $r_L$ having a resistance value $R_L$, a source of constant current or constant current source 1 supplying a constant current $I_0$, and an emitter follower constituted by a transistor $Q_1$ and a resistor $r_{EF}$. In such a reference voltage generating circuit, the emitter-collector voltage of transistor $Q_1$ is used as a reference voltage output and the temperature characteristic of this voltage $V_R$ is set by controlling the temperature characteristic of the current $I_0$ of the constant current source 1.

FIG. 2 shows another example of the prior art reference voltage generating circuit. As shown in FIG. 2, the constant current source 1 is generally constituted by a transistor $Q_2$ and a resistor $r_E$ having a resistance value of $R_E$ and the current value $I_0$ is controlled by selecting a suitable temperature characteristic for an output voltage $V_{CS}$ of a source of drive voltage or the driving voltage source 2 which is often commonly used for driving a plurality of gate circuits or the like other than the reference voltage generating circuit. A transistor $Q_4$ and a resistor $r'_E$ having a resistance value $R'_E$ supplies a constant current $I_1$ to any circuit network G and the driving voltage source 2 is commonly used for the reference voltage generating circuit and the circuit network G.

In FIG. 2, where the base-emitter forward voltage of the transistor $Q_3$ denoted by $V_F$, the current $I_0$ of the source of constant current is expressed by $$I_0 \approx (V_{CS} - V_F)/R_E$$

Hence the reference voltage $V_R$ is expressed by $$\begin{aligned} V_R &= -I_0 R_L - V_F \\ &\approx -\frac{R_L}{R_E}(V_{CS} - V_F) - V_F \\ &= -\frac{R_L}{R_E} \cdot V_{CS} + \left(\frac{R_L}{R_E} - 1\right) V_F \end{aligned}$$

In this equation, if we assume that a ratio $R_L/R_E$ is constant irrespective of a temperature variation, the temperature characteristic of the reference voltage $V_R$ is given by $$\frac{dV_R}{dT} \approx -\frac{R_L}{R_E} \cdot \frac{dV_{CS}}{dT} + \left(\frac{R_L}{R_E} - 1\right) \frac{dV_F}{dT}$$

Since $dV_F/dT$ can be considered as a physical parameter of the transistor, in order to make $dV_R/dT$ to a desired value, the temperature characteristic of the drive voltage $V_{CS}$ should be determined to satisfy the following equation $$\frac{dV_{CS}}{dT} = -\frac{R_E}{R_L}\left\{\frac{dV_R}{dT} - \left(\frac{R_L}{R_E} - 1\right)\frac{dV_F}{dT}\right\} \quad (1)$$

In the same manner, the desired temperature characteristic $dI_1/dT$ of current $I_1$ of another constant current source which also uses the driving voltage source 2 is expressed by $$\frac{dI_1}{dT} \approx \frac{1}{R'_E}\left(\frac{dV_{CS}}{dT} - \frac{dV_F}{dT} - I_1 \frac{dR'_E}{dT}\right)$$

In this equation, since $dV_F/dT$ and $dR'_E/dT$ are considered as the physical parameters of transistor $Q_4$ and resistor $r'_E$ respectively, where the value of $dV_{CS}/dT$ satisfying $dI_1/dT$ does not coincide with $dV_{cs}/dT$ satisfying equation (1), either one of the constant current sources should be driven by an independent driving voltage source for setting different ratio $V_{CS}dT$. In other words, it is impossible to provide any temperature characteristic for only the reference voltage generating circuit. This not only causes increase in the occupation area or volume and power consumption of semiconductor devices but also increases the number of driving voltage sources which are required to be designed precisely, thereby increasing the number of steps of design.

SUMMARY OF THE INVENTION

Accordingly, it is an object of this invention to provide an improved reference voltage generating circuit capable of setting any designed temperature characteristic not influenced by the temperature characteristic of the driving voltage of a constant current source.

According to this invention there is provided a reference voltage generating circuit comprising a source of constant current, a power supply having a high voltage terminal and a low voltage terminal, an emitter follower circuit connected across the high and low voltage terminals, first and second resistors with their one ends respectively connected to the high voltage terminal and the output terminal of the source of constant current and the other ends connected to the input terminal of the emitter follower circuit, a third resistor with one end connected to the high voltage terminal, a diode with its anode electrode connected to the other side of the third resistor and its cathode electrode connected to the output terminal of the source of constant current, and a reference voltage output terminal connected to an output terminal of the emitter follower circuit.

BRIEF DRAWING OF THE DRAWINGS

DESCRIPTION OF THE PREFERRED EMBODIMENTS

Figure 1:
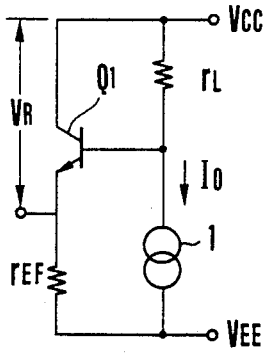
FIG.1 PRIOR ART
FIG. 1 is a connection diagram showing one example of the prior art reference voltage generating circuit.
Figure 2:
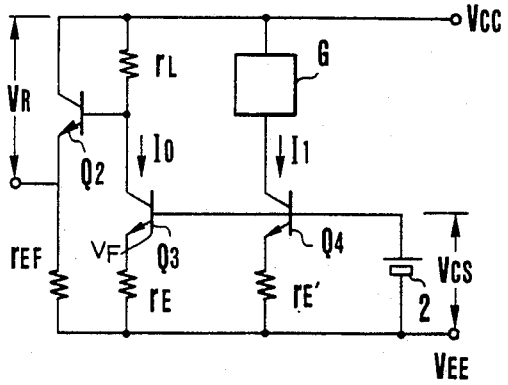
FIG.2 PRIOR ART
FIG. 2 is a connection diagram showing another example of the prior art reference voltage generating circuit.
Figure 3:
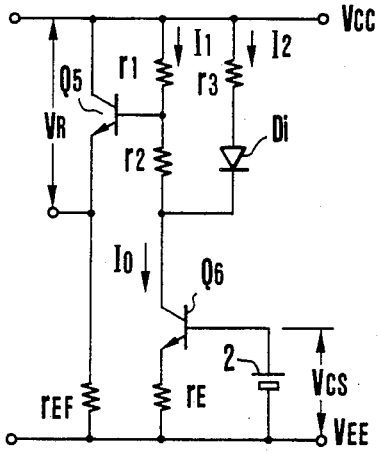
FIG. 3 is a connection diagram showing one embodiment of this invention.

In a preferred embodiment of the reference voltage generating circuit of this invention shown in FIG. 3, the collector electrode of a transistor $Q_5$ is connected to a high voltage source terminal $V_{CC}$ while the emitter electrode is connected to a low voltage source terminal $V_{EE}$ via a resistor $R_{EF}$. The transistor $Q_5$ and the resistor $r_{EF}$ thus form an emitter follower circuit wherein an input voltage is applied to the base electrode of the transistor $Q_5$ and the voltage $V_R$ across the emitter and collector electrodes of the transistor $Q_5$ is used as the output.

The emitter electrode of transistor $Q_6$ is connected to the low voltage source terminal $V_{EE}$ through a resistor $r_E$ having a resistance of $R_E$, while the base electrode is connected to a constant current driving voltage source 2, thus forming a source of constant current in which the collector current of the transistor $Q_6$ constitutes an output current.

One terminals of resistors $r_1$ and $r_3$ are connected to the high voltage source terminal $V_{CC}$. The other terminal of resistor $r_1$ is connected to the base electrode of transistor $Q_5$ together with one terminal of resistor $r_2$. The other terminal of resistor $r_3$ is connected to the anode electrode of a diode Di with the cathode electrode connected to the output terminal of the constant current source together with the other terminal of resistor $r_2$.

In FIG. 3, the current of the constant current source is denoted by $I_0$, and the currents flowing through resistor $r_1$ and $r_3$ are denoted by $I_1$ and $I_2$ respectively. Then voltage $V_R$ can be shown as follows.

$$V_R = -I_1R_1 - V_F \tag{2}$$

We also obtain $$I_1(R_1+R_2) = I_2R_3 + V_D \tag{3}$$

where $V_D$ represents the forward voltage of diode Di. Generally since $$V_D \approx V_F \tag{4}$$

we obtain $$I_0 = I_1 + I_2 = (V_{CS} - V_F)/R_E \tag{5}$$

From equations (3), (4) and (5) we obtain $$I_1 = \left\{ \frac{R_3}{R_E}(V_{CS} - V_F) + V_F \right\} /(R_1 + R_2 + R_3) \tag{6}$$

By substituting equation (6) into equation (2), the reference voltage $V_R$ can be expressed as follows $$V_R = -\frac{R_1}{\Sigma R}\cdot\frac{R_3}{R_E}\cdot V_{CS} + \left\{\frac{R_1}{\Sigma R}\left(\frac{R_3}{R_E} - 1\right) - 1\right\}V_F \tag{7}$$

where $\Sigma R = R_1 + R_2R_3$. From equation (7), the temperature characteristic of the reference voltage $V_R$ can be shown by $$\frac{dV_R}{dT} = -\frac{R_1}{\Sigma R}\cdot\frac{R_3}{R_E}\cdot\frac{dV_{CS}}{dT} + \left\{\frac{R_1}{\Sigma R}\left(\frac{R_3}{R_E} - 1\right) - 1\right\}\frac{dV_F}{dT} \tag{8}$$

Equation (7) shows the absolute value of the reference voltage, and equation (8) shows the temperature characteristic of the reference voltage.

Assuming a driving voltage $V_{CS}$ and its temperature characteristic $dV_{CS}/dT$ the base-emitter forward voltage of a transistor and its temperature characteristic are predetermined as the characteristic requirement of other commonly used circuits and the physical characteristics of transistors, it is sufficient to set two resistance ratios $R_1/\Sigma R$ and $R_3/R_E$ that they satisfy both equations (7) and (8).

More particularly, by substituting desired values of $V_R$ and $dV_R/dT$ and given value of $V_{CS}$, $dV_{CS}/dT$, $V_F$ and $dV_F/dT$ in equations (7) and (8) and by solving a simple simultaneous equations in which $R_1/\Sigma R$ and $R_3/R_E$ are unknown, we can obtain any values of $V_R$ and $dV_R/dT$.

More particularly, when the voltage source for generating the driving voltage $V_{CS}$ is constituted by a resistance voltage divider or a so-called band gap regulator circuit for obtaining a driving voltage $V_{CS}$ of 1.2 volts, the temperature coefficient $dV_{CS}/dT$ of this voltage $V_{CS}$ becomes substantially zero. The forward voltage $V_F$ across the base and emitter electrodes of a transistor is about 0.7 V, and its temperature coefficient $dV_F/dT$ is about $-2$ mV/°C. Accordingly, by selecting the resistance values of resistors $r_1$, $r_2$, $r_3$ and $r_E$ to be 320 Ω, 2.5K Ω and 240 Ω respectively, a reference voltage $V_R$ of 1.302 volts can be obtained from equation (7) and its temperature coefficient $dV_R/dT$ can be determined as $+8\times10^{-5}$ V/°C. from equation (8), which is substantially zero. Thus a reference voltage $V_R$, which is not affected by the temperature variation, can be produced. On the other hand, where the resistance values of resistors $r_1$, $r_2$, $r_3$ and $r_E$ are selected to the 480 Ω, 480 Ω, 540 Ω and 240 Ω respectively, the value of the reference voltage $V_R$ and its temperature coefficient would become $-1.284$ volts and $+1.2\times10^{-3}$ V/°C., thus producing a reference voltage which varies with the temperature.

As above described, when designing a reference voltage $V_R$ and its temperature coefficient $dV_R/dT$ according to this invention, the resistance ratios of respective resistors are used instead of their absolute values. Accordingly, although the absolute values of the resistance values vary greatly their relative ratios can be made highly precise, so that the invention is particularly useful for semiconductor integrated circuits.

Although in the foregoing embodiment NPN type transistors were used, PNP type transistors can also provide the same advantageous effects.

Figure 4:
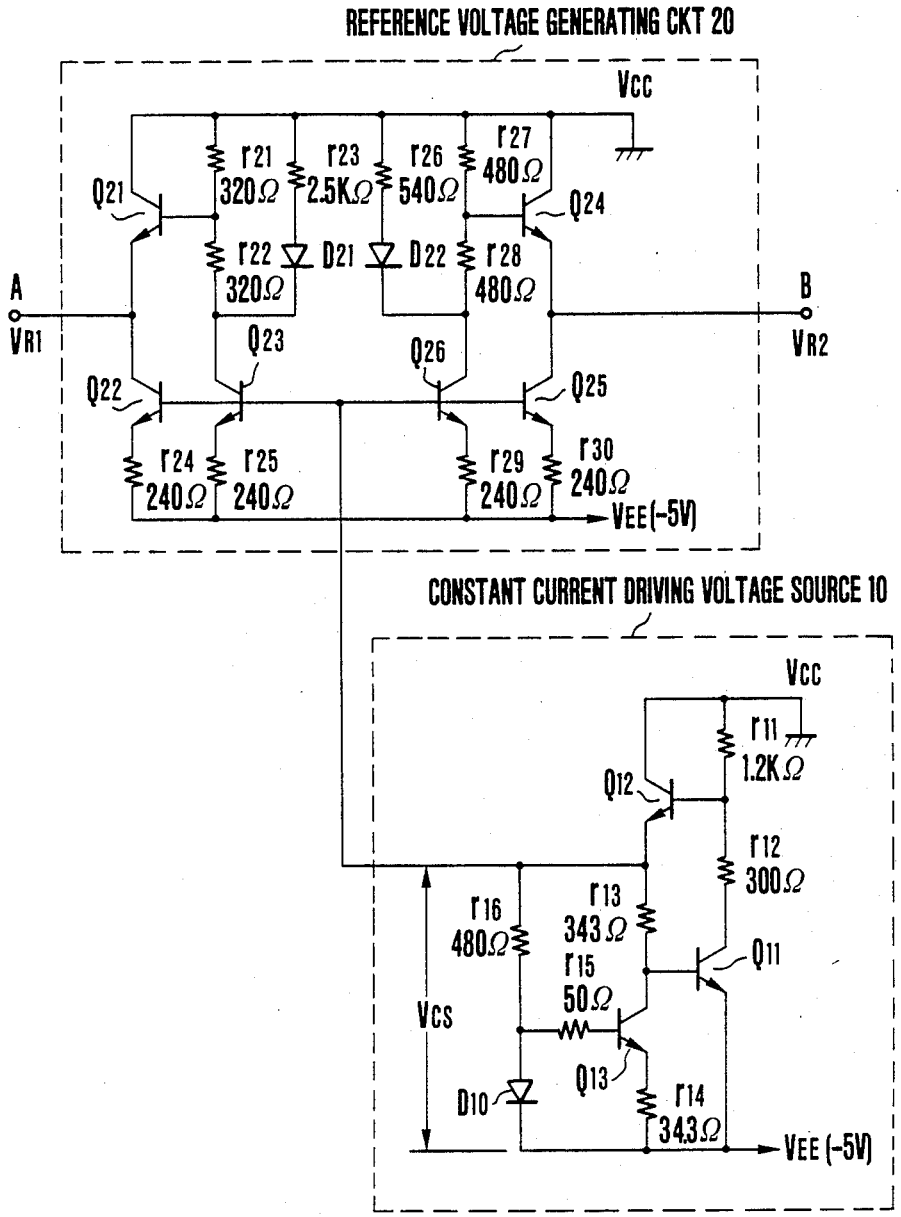
FIG. 4 is a connection diagram showing another embodiment of this invention.

FIG. 4 shows another embodiment of this invention capable of generating two reference voltages $V_{R1}$ and $V_{R2}$ having different temperature characteristics by using a driving voltage $V_{CS}$ from a common constant current driving voltage source 10.

For the purpose of judging whether a given input signal is logic "1" or "0", a circuit construction is often used wherein the input signal is applied to a comparator together with a reference signal for comparing the input signal level with the reference voltage. In such circuit construction, it is advantageous to control the temperature characteristic of the reference voltage in accordance with the temperature characteristic of the input signal level, from the standpoint of eliminating misoperation. For example, in a case where the input signal level is not influenced by temperature variation, it is advantageous that the reference voltage would not be infuenced by the temperature. On the other hand, where the input signal level has a positive temperature dependency, it is advantageous that the reference voltage too has a positive temperature characteristic. It was found that the circuit shown in FIG. 4 can satisfy the requirements described above.

In FIG. 4, there are provided a constant current driving voltage source 10 and a reference voltage generating circuit 20. The high voltage terminal $V_{CC}$ of the driving voltage source 10 is grounded, while the low voltage terminal $V_{EE}$ is maintained at a voltage of $-5$ V. The constant current driving voltage source 10 is of the well known band gap generator system. Thus, across source terminals $V_{CC}$ and $V_{EE}$ are connected a series circuit including resistors $r_{11}$ and $r_{12}$ and a transistor $Q_{11}$ and a series circuit including a transistors $Q_{12}$, a resistor $r_{13}$, a transistor $Q_{13}$ and a resistor $r_{14}$. The junction between resistors $r_{11}$ and $r_{12}$ is connected to the base electrode of transistor $Q_{12}$. The collector electrode of transistor $Q_{13}$ is connected to the base electrode of transistor $Q_{11}$. A resistor $r_{16}$ and a diode $D_{10}$ are connected in series between the emitter electrode of transistor $Q_{12}$ and the low voltage source terminal $V_{EE}$, and the junction between the resistor $r_{16}$ and diode $D_{10}$ is connected to the base electrode of transistor $Q_{13}$ via resistor $r_{15}$.

When the resistance values of the resistors are selected as shown in FIG. 4, the output voltage $V_{CS}$ of the constant current driving voltage source 10 and the temperature coefficient of the voltage $V_{CS}$ become 1.2 V and 0 V/°C. respectively. In other words, the driving voltage $V_{CS}$ becomes substantially constant even when the temperature changes. This driving voltage $V_{CS}$ is supplied to the reference voltage generating circuit 20 having a symmetrical construction on the left and right sides.

On the left side, the collector electrode of transistors $Q_{21}$ is connected to the grounded high voltage source terminal $V_{CC}$, while the emitter electrode is connected to a terminal A together with the collector electrode of transistor $Q_{22}$. The terminal A acts as the output terminal of a first reference voltage $V_{R1}$. The emitter electrode of transistor $Q_{22}$ is connected to the low voltage source terminal $V_{EE}$ ($-5$ V) via resistor $r_{24}$.

One ends of resistors $r_{21}$ and $r_{23}$ are connected to the high voltage source terminal $V_{CC}$. The other end of resistor $r_{21}$ is connected to the base electrode of transistor $Q_{21}$ together with one end of resistor $r_{22}$ while the other end of resistor $r_{23}$ is connected to the anode electrode of diode $D_{21}$. The other end of resistor $r_{22}$ and the cathode electrode of diode $D_{21}$ are connected to the collector electrode of transistor $Q_{23}$ with its emitter electrode connected to the low voltage source terminal $V_{EE}$ via resistor $r_{25}$. The base electrode of transistors $Q_{22}$ and $Q_{23}$ are connected to the constant current driving voltage source 10 to be supplied with the driving voltage $V_{CS}$.

The right hand side of the reference voltage generating circuit 20 has the same construction as the left hand side. That is, transistors $Q_{21}$ and $Q_{22}$ correspond to transistors $Q_{24}$ and $Q_{25}$, resistors $r_{21}$, $r_{22}$, $r_{23}$, $r_{24}$ and $r_{25}$ respectively correspond to resistors $r_{27}$, $r_{28}$, $r_{26}$, $r_{30}$ and $r_{29}$, and diode $D_{21}$ corresponds to diode $D_{22}$. The junction between transistors $Q_{24}$ and $Q_{25}$ is connected to an output terminal B producing a second reference voltage $V_{R2}$.

Since the values of respective resistors in the circuit 20 are selected as shown in FIG. 4, the reference voltage $V_{R1}$ and its temperature coefficient are determined as $-1.302$ V and $+0.08$ mV/°C. from equations (7) and (8) while the reference voltage $V_{R2}$ and its temperature coefficient are determined as $-1.284$ V and $+1.2$ mV/°C. Thus, in response to the common driving voltage $V_{CS}$, the reference voltage generating circuit 20 generates a reference voltage $V_{R1}$ not depending upon the temperature and a reference voltage $V_{R2}$ having a negative temperature coefficient. The output voltages $V_{R1}$ and $V_{R2}$ are used as reference voltages for 100K ECL (Emitter Coupled Logic) and 10K ECL respectively.

Figure 5:
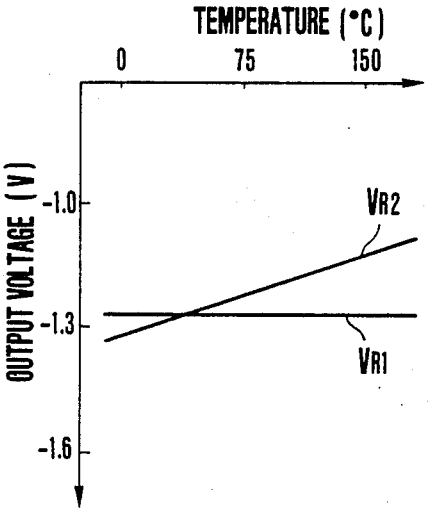
FIG. 5 is a graph showing the output characteristics of the embodiment shown in FIG. 4.

FIG. 5 is a graph showing the relation between the temperature variation and the voltage variation of the reference voltages $V_{R1}$ and $V_{R2}$.

Accordingly, if the level of the input signal to be compared does not depend upon the temperature, the reference voltage $V_{R1}$ is used. However, if the input signal level has a positive temperature coefficient, the reference voltage $V_{R2}$ is used. Accordingly, the logic judgement of the level of the input signal can be made without being influenced by the temperature variation. Switching between reference voltages $V_{R1}$ and $V_{R2}$ may be made with an electronic switch. If the temperature characteristic of the input signal to be detected is already known, the terminals generating the reference voltage $V_{R1}$ or $V_{R2}$ may be connected with a conductor.

The combination of values of various resistors, driving voltages $V_{CS}$ and the temperature coefficient is not limited to the illustrated example and can be suitably changed.

As above described, according to this invention, where the resistance ratio between resistors is suitably selected, the output voltage and its temperature characteristic of the reference voltage generating circuit can be disigned as desired without being limited by the absolute value of the voltage for driving the constant current source, whereby it is not necessary to increase the number of driving voltage sources. Accordingly, it is possible to obtain a reference voltage generating circuit that can efficiently utilize the chip area and simplify the design of a semiconductor integrated circuit.

What is claimed is:

1. A reference voltage generating circuit comprising:

a current source;

a potential terminal;

a first series connection circuit including a first resistor having one terminal connected to said current source, a second resistor having one terminal connected to another terminal of said first resistor, and a first transistor having a collector electrode connected to another terminal of said second resistor, an emitter electrode connected to said potential terminal via a resistor, and a base electrode connected to said potential terminal via a bias voltage source;

a third resistor having one terminal connected to said current source;

a diode having one terminal connected to another terminal of said third resistor, said diode having another terminal connected to the other terminal of said second resistor;

a second series connection circuit including a second transistor having a collector electrode connected to said current source, an emitter electrode connected to said potential terminal via a resistor, and a base electrode connected to a junction between said first and second resistors, an output voltage $V_R$ of said reference voltage generator being obtained between the collector and emitter electrodes of said second transistor;

said output voltage $V_R$ and a temperature characteristic $dV_R/DT$ of the voltage $V_R$ being represented by the following equations:

$$V_R = -\frac{R_1}{R}\cdot\frac{R_3}{R_E}\cdot V_{CS} + \left\{\frac{R_1}{R}\left(\frac{R_3}{R_E}-1\right)-1\right\}V_F$$

$$\frac{dV_R}{dT} = -\frac{R_1}{R}\cdot\frac{R_3}{R_E}\cdot\frac{dV_{CS}}{dT} + \left\{\frac{R_1}{R}\left(\frac{R_3}{R_E}-1\right)-1\right\}\frac{dV_F}{dT}$$

where $R_1$, $R_2$, $R_3$, and $R_E$ are resistances of first, second, third resistors and of the resistor connected to the emitter electrode of said first transistor, $R=R_1+R_2+R_3$, $V_{CS}$ is an output voltage of said bias voltage source, and $V_F$ is a forward voltage of the diode.

2. A reference voltage generating circuit comprising:

a current source terminal;

a potential terminal;

a bias voltage source terminal;

two output voltage terminals;

tow component circuits, having a similar construction, each of said coponent circuits being connected in common with said current source terminal, said potential terminal and said bias voltage source terminal, one of said two component circuits comprising a first series connection circuit including a first resistor having one terminal connected to said potential terminal, a second resistor having one terminal connected to another terminal of said first resistor, and a first transistor having a collector electrode connected to another terminal of said second resistor, an emitter electrode connected to said current source via a resistor and a base electrode connected to said bias voltage source terminal;

a third resistor having one terminal connected to said potential terminal;

a diode having one terminal connected to another terminal of said third resistor and another terminal connected to the collector electrode of said first transistor; and a second series connection cicuit including a second transistor having a collector electrode connected to said potential terminal, an emitter electrode connected to one of said two output voltage terminals, and a base electrode connected to the junction of said first and second resistors, and a third transistor having a collector electrode connected to said one output voltage terminal, an emitter electrode connected to said current source via a resistor, and a base electrode connected to said bias voltage source terminal;

the other of said two component circuits including a construction which is similar to the construction of said one component circuit, the resistance values of said first, second and third resistors of the other component circuit being different from the resistance values of the one component circuit; the two output voltage terminals having voltage output temperature characteristics which are different from each other.

3. The reference voltage generating circuit according to claim 2 wherein said bias voltage source comprises a third series connection circuit including a fourth resistor having one terminal connected to said potential terminal, a fifth resistor having one terminal connected to another terminal of said fourth resistor, and a fourth transistor having a collector electrode connected to another terminal of said fifth resistor, an emitter connected to said current source terminal; a fourth series connection circuit including a fifth transistor having a collector electrode connected to said potential terminal, an emitter electrode connected to said bias voltage source terminal, and a base electrode connected to the junction between said fourth and fifth resistors, a sixth resistor having one terminal connnected to the emitter electrode of said fifth transistor and another terminal connected to a base electrode of said fourth transistor, and a sixth transistor having a collector connected to the other terminal of said sixth resistor, an emitter electrode connected to said current source via a resistor, a seventh resistor having one terminal connected to the emitter of said fifth transistor and another terminal connected to a base electrode of said sixth transistor via a resistor, and a diode having one terminal connected to the other end of said seventh resistor and another terminal connected to said current source terminal.

4. A reference voltage generating circuit according to claim 2 wherein a reference voltage output from one of said two output voltage terminals is selected in response to a temperature coefficient of an input voltage which is to be compared with the reference voltage output from said reference voltage generating circuit, said input voltage being compared with said selected output voltage.

* * * * *